US010595107B2

(12) United States Patent
Vitt et al.

(10) Patent No.: US 10,595,107 B2
(45) Date of Patent: Mar. 17, 2020

(54) SPEAKER MODULE ARCHITECTURE

(71) Applicant: Apple Inc., Cupertino, CA (US)

(72) Inventors: Nikolas T. Vitt, Sunnyvale, CA (US); David M. Pelletier, Cupertino, CA (US); Miodrag Pejin, Campbell, CA (US); Christopher Wilk, Los Gatos, CA (US); Mark A. Murphy, San Francisco, CA (US); Brad G. Boozer, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/710,779

(22) Filed: Sep. 20, 2017

(65) Prior Publication Data

US 2018/0084324 A1 Mar. 22, 2018

Related U.S. Application Data

(60) Provisional application No. 62/397,183, filed on Sep. 20, 2016.

(51) Int. Cl.

| | |
|---|---|
| ***H04R 1/02*** | (2006.01) |
| ***H04R 9/06*** | (2006.01) |
| ***H04R 9/02*** | (2006.01) |
| ***H04R 3/00*** | (2006.01) |
| ***H04R 1/44*** | (2006.01) |

(52) U.S. Cl.

CPC ..... *H04R 1/026* (2013.01); *H04R 1/023* (2013.01); *H04R 1/025* (2013.01); *H04R 3/007* (2013.01); *H04R 9/025* (2013.01); *H04R 9/06* (2013.01); *H04R 1/44* (2013.01); *H04R 2201/023* (2013.01)

(58) Field of Classification Search

CPC combination set(s) only.
See application file for complete search history.

(56) References Cited

U.S. PATENT DOCUMENTS

| | | | |
|---|---|---|---|
| 4,312,580 | A | 1/1982 | Schwomma et al. |
| 5,041,330 | A | 8/1991 | Heerten et al. |
| 5,373,487 | A | 12/1994 | Crawford et al. |
| 5,420,935 | A | 5/1995 | Ikuo et al. |
| 6,389,143 | B1 | 5/2002 | Leedom et al. |
| 6,855,173 | B2 | 2/2005 | Ehrnsperger et al. |
| 6,983,130 | B2 | 1/2006 | Chien et al. |
| 7,605,687 | B2 | 10/2009 | Morris et al. |

(Continued)

FOREIGN PATENT DOCUMENTS

| | | |
|---|---|---|
| JP | 4271507 | 6/2009 |
| WO | 2012117476 | 9/2012 |
| WO | 2015167848 | 11/2015 |

*Primary Examiner* — Sunita Joshi
(74) *Attorney, Agent, or Firm* — Kilpatrick Townsend & Stockton LLP

(57) ABSTRACT

An electronic device includes a housing having an opening comprising an audio port and a speaker assembly carried by the device housing. The speaker assembly includes a water ejection system having a diaphragm coupled to a magnetic driver and a mesh that covers the audio port where the diaphragm and the mesh together define an acoustic volume. When a water ejection signal is received at the magnetic driver, the magnetic driver is caused to move the diaphragm in a manner that ejects water contained within the acoustic volume out of the acoustic volume and through the mesh.

13 Claims, 5 Drawing Sheets

(56) References Cited

U.S. PATENT DOCUMENTS 7,876,919 B2 * 1/2011 Ram ..... H04R 1/086 381/322
8,054,992 B2 11/2011 Sapiejewski
D653,640 S 2/2012 Kwon et al.
8,135,149 B2 3/2012 Yoshida et al.
8,525,689 B2 9/2013 Lewis et al.
8,558,708 B2 10/2013 Albert et al.
8,670,586 B1 * 3/2014 Boyle ..... H04R 1/1008 381/370
8,810,426 B1 8/2014 Morris
8,826,558 B2 9/2014 Priebe et al.
8,844,158 B2 9/2014 Dehn
9,072,991 B2 7/2015 Winters et al.
9,080,961 B2 7/2015 Adachi
9,084,053 B2 7/2015 Parkins
9,094,747 B2 7/2015 Rayner
9,161,434 B2 10/2015 Merz et al.
9,179,220 B2 11/2015 Morris
9,204,525 B2 12/2015 Thompson et al.
9,220,328 B2 12/2015 Magness
9,226,076 B2 12/2015 Lippert et al.
9,335,355 B2 5/2016 Keeler et al.
9,451,354 B2 9/2016 Zadesky et al.
9,469,469 B2 10/2016 Rayner
9,573,165 B2 2/2017 Weber et al.
9,660,684 B2 5/2017 Rayner
9,774,192 B2 9/2017 Wojcik et al.
9,820,038 B2 11/2017 Salvatti et al.
2006/0198547 A1 * 9/2006 Hampton ..... H04R 1/023 381/395
2007/0003081 A1 1/2007 Ram et al.
2008/0149417 A1 6/2008 Dinh et al.
2009/0281251 A1 11/2009 Bae et al.
2010/0224574 A1 9/2010 Youngs et al.
2010/0278368 A1 11/2010 Martin et al.
2011/0077063 A1 3/2011 Yabe et al.
2011/0097571 A1 4/2011 Tee et al.
2012/0082317 A1 4/2012 Pance et al.
2012/0198718 A1 8/2012 Odueyungbo et al.
2013/0170109 A1 * 7/2013 Cohen ..... H04M 1/03 361/679.01
2013/0170685 A1 7/2013 Oh et al.
2013/0242481 A1 9/2013 Kim et al.
2013/0333978 A1 12/2013 Abe et al.
2014/0048351 A1 * 2/2014 Banter ..... G10K 11/002 181/286
2014/0083296 A1 3/2014 Sanders
2014/0093095 A1 * 4/2014 Slotte ..... H04R 1/02 381/87
2014/0112510 A1 4/2014 Yang et al.
2014/0193018 A1 7/2014 Lim et al.
2014/0321662 A1 10/2014 Kihm et al.
2014/0334653 A1 11/2014 Luna et al.
2015/0319534 A1 * 11/2015 Lippert ..... H04R 1/023 381/165
2016/0353186 A1 12/2016 Rothkopf
2017/0127163 A1 5/2017 Weber et al.

* cited by examiner

SPEAKER MODULE ARCHITECTURE

CROSS-REFERENCES TO RELATED APPLICATIONS

This application claims priority to U.S. Provisional Patent Application No. 62/397,183, filed on Sep. 20, 2016, the disclosure of which is hereby incorporated by reference in its entirety for all purposes.

FIELD

The described embodiments relate generally to methods for preventing liquids, such as water, from entering a device housing of a portable electronic device. More particularly, the present embodiments relate to methods and apparatus for ejecting captured liquid from a speaker module thereby preventing the liquid from entering into the device housing.

BACKGROUND

As an electronic device assumes progressively thinner profiles, internal electronic components suitable for performing various tasks can be more compactly organized. Accordingly, components sensitive to an intrusion of liquids, such as water, can be located closer towards various openings of the electronic device rendering them commensurably more susceptible. For this reason, improvements in mechanisms that improve water resistance are desirable.

SUMMARY

This paper describes various embodiments that relate to methods and apparatus for removing water from a speaker assembly.

A wearable electronic device is disclosed and includes the following: a housing having a housing wall defining an audio port including a first opening separated from a second opening by a portion of the housing wall; and a speaker assembly coupled to an interior-facing surface of the housing wall to create an acoustic volume between a portion of the housing wall defining the audio port and the speaker assembly, the speaker assembly including: a diaphragm configured to move air contained within the acoustic volume and that is aligned with the portion of the housing wall separating the first opening from the second opening, and a mesh assembly including a mesh that allows water to pass out of the acoustic volume and hinders water from passing into the acoustic volume.

An electronic device is disclosed and includes the following: a housing defining an interior volume and having a housing wall defining an audio port leading into the interior volume; and a speaker assembly disposed within the interior volume proximate the audio port, the speaker assembly extending between opposing interior-facing surfaces of the housing wall to seal a portion of the interior volume operative as an acoustic volume between the speaker assembly and a portion of the housing wall defining the audio port. The speaker assembly includes a water ejection system comprising a diaphragm that is aligned with the audio port and a magnetic driver configured to generate a magnetic field that induces movement of the diaphragm to produce an audible sound by moving air contained within the acoustic volume. When a water ejection signal is received at the speaker assembly, the magnetic driver causes the diaphragm to vibrate to force the water contained within the acoustic volume to follow a direct flow path through the audio port.

A speaker assembly carried by a housing of an electronic device is disclosed and includes the following: a driver unit configured to receive a water ejection signal based upon an indication that an amount of water is contained within an acoustic volume of the speaker assembly; a diaphragm magnetically coupled to the driver unit; a mesh that covers an opening defined by a housing wall of the housing, the diaphragm and the mesh defining the acoustic volume; and a sealing element positioned between an interior-facing surface of the housing wall and the speaker assembly to block a water ingress path around the speaker assembly. In response to the water ejection signal the diaphragm, which is directly aligned with the mesh, is driven by the driver unit to move in a manner that forces at least some of the amount of water out of the acoustic volume and through the opening in the housing.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
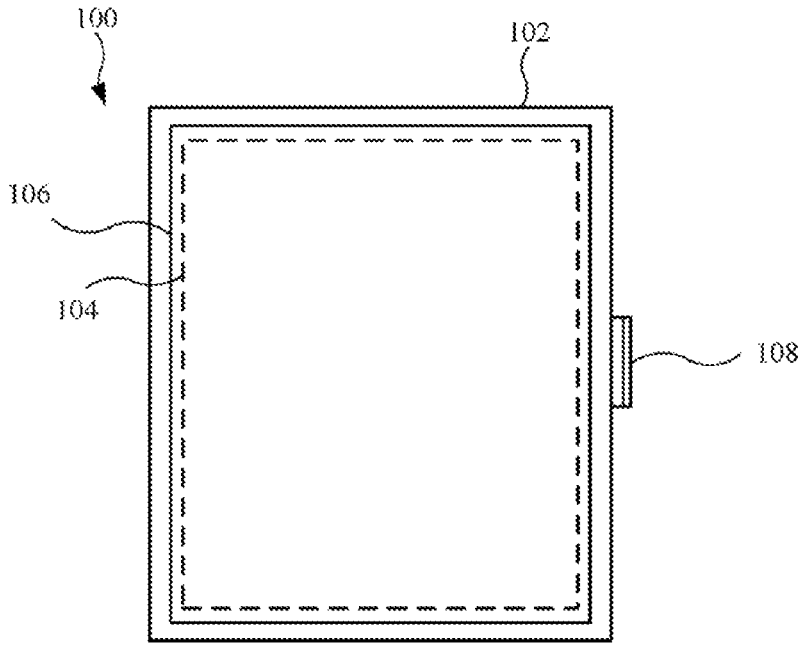
FIG. 1A illustrates a front view of an embodiment of an electronic device, in accordance with the described embodiments.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Speaker assemblies often use an acoustic driver for converting an electrical signal that includes auditory information generated by an audio processor into audible sound. In one embodiment, the acoustic driver can include a magnetic element responsive to the electrical signal. In one embodiment, the magnetic element can take the form of an electromagnet or electro-permanent magnet. Accordingly, the electrical signal can be used to modulate a magnetic field generated by the electromagnet by varying an amount of control current provided to the electromagnet. In this way, a magnetic field can be created that can form a magnetic circuit with a magnetic coupler (such as a permanent magnet or more simply a ferromagnetic structure) coupled to a diaphragm that moves in accordance with the movement of the magnetic coupler caused by the magnetic field. In one embodiment, the electromagnet can be partitioned into a primary electromagnet associated with a primary acoustic driver and a secondary electromagnet associated with a secondary acoustic driver each having a corresponding magnetic shunt structure (generally formed of steel or other ferromagnetic material) that can be used to concentrate magnetic field lines onto the magnetic coupler thereby enhancing the corresponding magnetic circuit. In this way, movement of the diaphragm can be optimized to produce the audible sound having a large dynamic range. In order to provide the audible sound having optimal acoustic properties (such as volume), the diaphragm and the associated acoustic volume can be located in close proximity to an opening (also referred to as an audio port) in the housing such that a direct air path having an overall reduced resistance to air flow can facilitate generation of and porting of the audible sound to an external environment.

In the described embodiment, the speaker assembly can include a semi-porous mesh that covers the opening. The semi-porous mesh can provide a barrier to the ingress of liquid, such as water, into the acoustic volume and yet, at the same time, facilitate the egress of the liquid from the acoustic volume. Moreover, the mesh can act as a structural element in that at least in some embodiments, the mesh can provide a compression force directed towards a perimeter of the mesh that can act on a speaker assembly frame. The compressive force on the frame can cause the frame to compress a seal (that can take the form of an O-ring) located between an interior surface of the housing and the frame. In this way, a potential leak path that circumvents the speaker assembly and leads directly to an interior volume defined by the housing can be blocked. The mesh can take many forms such as, for example, a weave formed of plastic or other non-magnetic material. The woven mesh can have pores with a size and shape that facilitates egress of water from the acoustic volume while restricting the flow of water into the acoustic volume. In one embodiment, a rib structure can span a length of the mesh. The rib structure can be used to provide structural support for the mesh thereby preventing bending, wrinkling or other mechanical deformation of the mesh that, in turn, can preserve an appearance of the mesh as viewed from the perspective of an outside observer.

In one embodiment, the audio ports can be arranged in such a way that any water from an exterior environment that passes through the ports and makes its way through the mesh can be directed to a specific portion of the speaker assembly. More particularly, the specific portion can be associated with those components used to expel water from the acoustic volume. In the described embodiments, the components used to expel water from the acoustic volume can be associated with that portion of the diaphragm corresponding to the primary acoustic driver unit that in one embodiment corresponds to the primary electromagnet. In this way, a maximum expulsion force in the form of mechanical energy can be generated capable of expelling an amount of water using the least amount of energy from, for example, a battery.

These and other embodiments are discussed below with reference to FIGS. 1-5; however, those skilled in the art will readily appreciate that the detailed description given herein with respect to these figures is for explanatory purposes only and should not be construed as limiting.

FIG. 1A illustrates a front view of an embodiment of an electronic device 100, in accordance with some described embodiments. In some embodiments, the electronic device 100 is a tablet device. In other embodiments, the electronic device 100 is a mobile wireless communication device, such as a smartphone. In some embodiments, the electronic device 100 is a wearable electronic device, similar to a watch. In any of the foregoing embodiments, the electronic device 100 can include wireless communication capabilities. As shown, the electronic device 100 can include housing 102. In some embodiments, housing 102 can be formed from a metal, which may be aluminum or stainless steel. In other embodiments, housing 102 can be a metal alloy. Further, in some embodiments, housing 102 can be formed of a non-metal, such as ceramic.

Electronic device 100 can also include display assembly 104 (shown as a dotted line) configured to present visual content and overlaid by protective layer 106 secured with the housing 102. In some embodiments, protective layer 106 can be formed of optically clear material such as glass, sapphire, and so on. Protective layer 106 can generally include any material that provides a protective and transparent cover for the display assembly 104. In some embodiments, display assembly 104 can include a touch-sensitive layer designed to respond to a tactile input on protective layer 106.

Electronic device 100 can also include one or more input features, such as an input feature 108. Input feature 108 can include a dial designed to rotate in response to a rotational force. Input feature 108 can include a button designed to actuate in a direction toward the housing 102 in response to a force. Input feature 108 can be used to generate an input to or command to a processor circuit (not shown) in the electronic device 100. In response to the input or command, the processor circuit may use an executable program stored on a memory circuit (not shown) to change the visual content displayed on the display assembly 104. Also, electronic device 100 can also include one or more radio circuits (not shown) allowing electronic device 100 to connect to a network as well as pair with an additional electronic device, such as a wireless communication device.

Also, although not shown, when electronic device 100 is a wearable electronic device, electronic device 100 can include one or more bands that wrap around an appendage (a wrist, for example) of a user. Also, housing 102 may include cavities or partial openings to receive and mechanically interlock with the bands, with the cavities allowing for the removal and replacement of the bands with different bands.

Figure 1B:
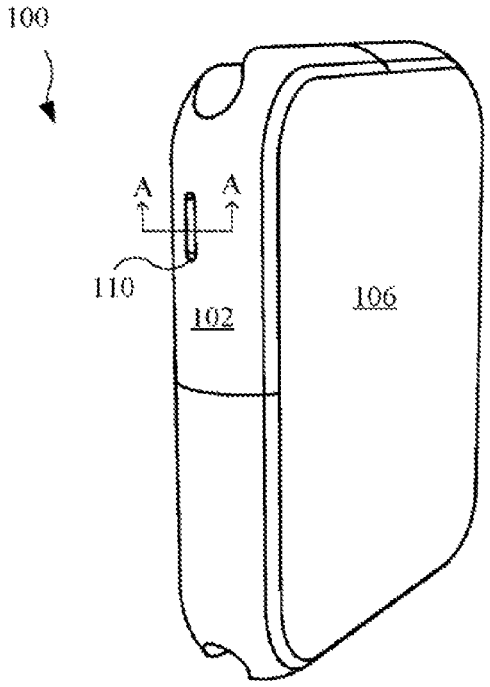
FIG. 1B illustrates an isometric view of the electronic device shown in FIG. 1A in the form of a wearable electronic device.

FIG. 1B illustrates an isometric view of the electronic device shown in FIG. 1A in the form of a wearable electronic device such as an Apple Watch™ manufactured by Apple Inc. of Cupertino Calif., showing opening 110 in the enclosure 102. Opening 110 may be used with an operational component (not shown) in the electronic device 100. For example, the opening 110 can take the form of an audio port that can allow acoustical energy (or sound) outside the electronic device 100 to enter the electronic device via the opening 110, such that a microphone (not shown) in the electronic device 100 may use the acoustical energy to generate an audio signal (or signals). The electronic device 100 may include other operational components, such as an audio driver (or audio speaker) and/or a barometric (pressure) sensor. In this regard, the enclosure 102 may include additional openings (not shown). Further, the openings may be disposed along various locations of the enclosure 102 based in part on a location of the operational components. Also, the openings may vary in size and shape. Further, the number of openings may vary according to the functionality of the electronic device 100. For example, an additional opening (not shown) may be used in conjunction with the opening 110 (hereinafter referred to as audio port 110) to enhance the audible sound from an audio driver in the electronic device 100.

Figure 2:
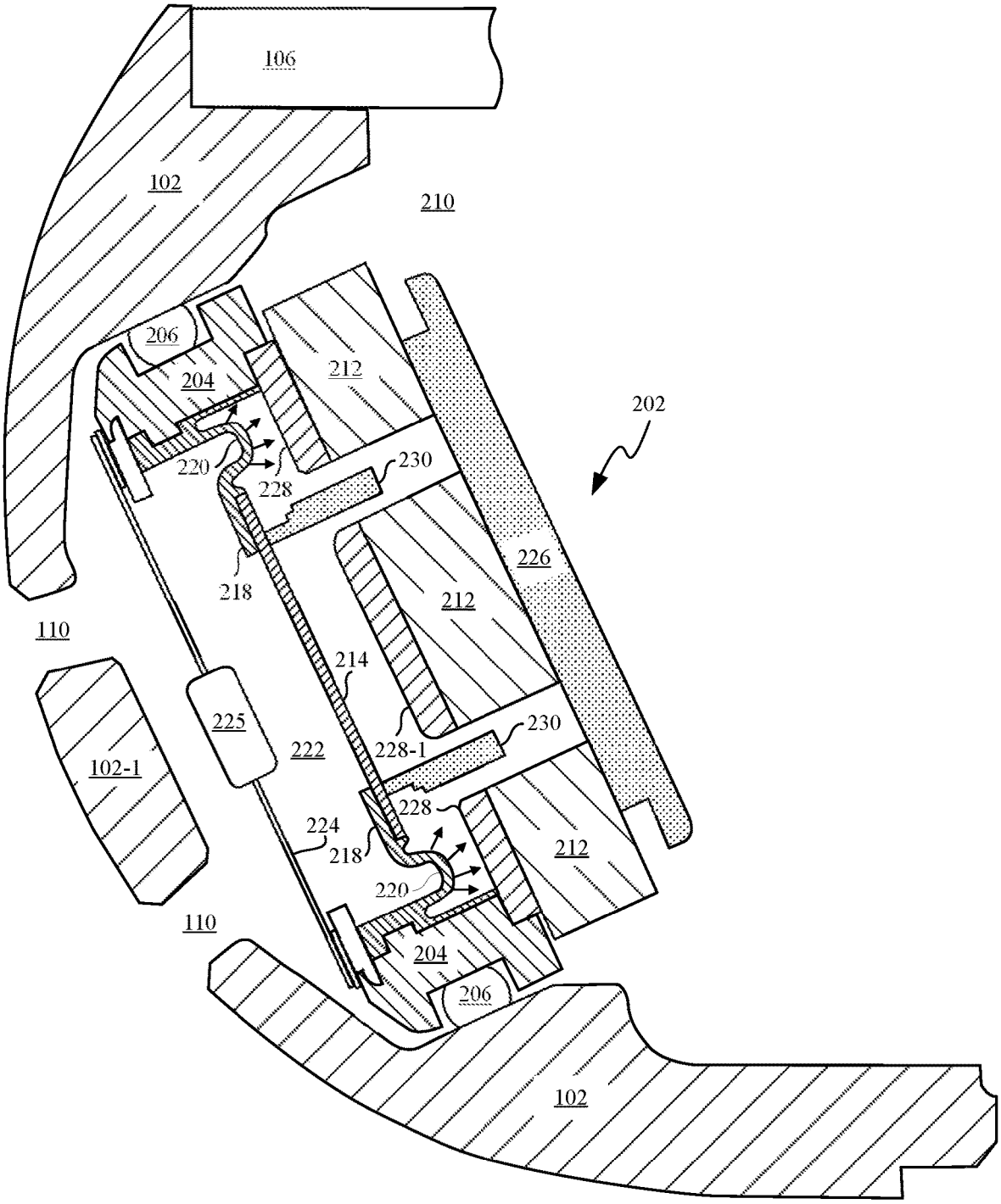
FIG. 2 shows cross sectional side view of a portion of a housing of the electronic device shown in FIG. 1B in accordance with section line A-A having a speaker assembly in accordance with the embodiments.

FIG. 2 shows a partial cross-sectional view 200 of electronic device 100 in accordance with section line A-A showing a cross section of a curved embodiment of housing 102, cover glass 106 and audio port 110. In particular, housing 102 can take the form of a wearable electronic device such as the Apple Watch™. In some embodiments, housing 102 can be strapped to a user's wrist using a wristband attached to opposing sides of housing 102. Speaker assembly 202 can include frame 204. Sealing element 206 can be located between housing 102 and frame 204. Sealing element 206 can be used to block a potential leak path from audio port 110 to interior 210 of electronic device 100. Sealing element 206 can take many forms, such as an O-ring. Speaker assembly 202 can also include acoustic drivers 212 that can cause diaphragm 214 to move in response to an electrical signal carried by electrical connector 216. Diaphragm 214 can be a semi-rigid membrane formed from material that provides excellent properties for providing high quality auditory output. In some embodiments, the material can be polypropylene, mineral/fiber filled polypropylene, thermoplastic polyurethane (TPU), thermoplastic elastomers (TPE), and polyether ether ketone (PEEK). In the described embodiment, diaphragm 214 can be flexibly connected to frame 204 by flexible connectors 218. Flexible connectors 218 can have folded segment 220 that can expand in accordance with an amount of water contained within acoustic volume 222. Acoustic volume 222 can be defined at least in part by diaphragm 214, mesh 224 and flexible connector 218.

Acoustic volume 222 can contain an amount of air that can be put in motion by movement of diaphragm 214. The movement of the amount of air can result in acoustic energy passing directly through mesh 224 and out through audio port 110. The acoustic energy can be capable of being perceived as an audible sound. It should be noted that acoustic drivers 212 can take the form of magnets at least one of which can be an electromagnet or electro-permanent magnet that can receive an electrical signal by way of electrical connector 226. In this way, magnets 212 can provide a magnetic field that can vary in accordance with the electrical signal or information embedded therein. It should be noted that in some cases, a magnetic shunt in the form of a ferromagnetic material could be used to concentrate the magnetic field lines of the magnetic field provided by (electro) magnets 212. For example, magnetic shunts 228 (also referred to as plates 228 where 228-1 can be further referred to as a mid-plate) can be used to re-direct magnetic field lines that would otherwise extend into acoustic volume 222 back into magnetic couplers 230 that are coupled to diaphragm 214 thereby increasing the frequency response and amplitude of the audible sound.

It should be noted that in some embodiments, mesh 224 could act as a structural element providing structural support for speaker assembly 202. For example, mesh 224 can provide a compressive force to frame 204 causing frame 204 to press against sealing element 206 thereby ensuring a good seal between frame 204 and housing 102. In one embodiment, rib element 225 can be used to maintain a shape of mesh 224. Rib element 225 can span mesh 224 and in so doing prevent mechanical deformation (such as wrinkling) in mesh 224 thereby preventing cosmetic defects that can be viewable by an observer. Rib element 225 can be oriented parallel to a portion 102-1 of housing 102 that separates openings 110.

In one embodiment, acoustic drivers 212 can take the form of magnets at least one of which is an electromagnet that provides a magnetic field having magnetic field properties that can vary in accordance with information provided by the electrical signal. For example, presuming that at least acoustic drivers 212 are electromagnets, then in order to magnetically couple the magnetic field provided with diaphragm 212, magnetic couplers 230 formed of magnetically active material (such as iron or steel) can be attached to diaphragm 214. In this way, the magnetic field provide by (electro)magnets 212 can form a magnetic circuit with magnetic coupler 230 by, for example, moving in accordance with the varying magnetic field. The movement of magnetic couplers 230 can, in turn, cause, a corresponding movement of diaphragm 214 resulting in movement of air contained within acoustic volume 222.

Mesh 224 can be formed of many materials such as plastic or non-magnetic metal in order to avoid interfering with the actions of electromagnets 212. It should be noted, however, that with suitable magnetic shielding, mesh 224 can be formed of metal having magnetic properties and therefore cannot be excluded from consideration. In one embodiment, mesh 224 can take the form of a weave with pores having a size and shape that facilitates movement of water out from acoustic volume 222 while hindering movement of water into acoustic volume 222. It is this semi-porous nature that helps to prevent an accumulation of water in acoustic volume 222. However, in those cases where water manages to enter through audio port 110, audio port 110 can have a size and orientation that directs most of the water passing there through directly to diaphragm 214 by way of mesh 224. In this way, upon receipt of a signal by electromagnets 212 indicating a presence of the water in acoustic volume 222, electromagnets 212 can respond by generating a magnetic field that causes diaphragm 214 to move in such a way as to force at least some of the water contained within acoustic volume 222 to pass through mesh 224 and through audio port 110 to an external environment. It should be noted that diaphragm 214 can be aligned generally perpendicular to a direction of water expulsion from acoustic volume 222. Accordingly, a long axis of diaphragm 214 can be generally perpendicular to a line extending through audio port 110. Therefore, the orientation of speaker module 202 with respect to housing 102 and audio port 110 provides for a generally direct path for expulsion of water contained within acoustic volume 222. Furthermore, speaker assembly 202 can be located directly against housing 102 (save for sealing element 206) thereby reducing and/or eliminating any intervening structure that would otherwise impede the expulsion of water from acoustic volume 222. For example, if diaphragm 214 takes on a shape of an ellipse, the long axis of diaphragm 214 can correspond to the major axis of the ellipse whereas if diaphragm 214 takes on a rectangular shape, the long axis can correspond to a length of the rectangle.

It should be noted that due to the close proximity of diaphragm 214 to audio port 110 and the semi-permeable nature of mesh 224, a resistance to fluid flow from acoustic volume 222 to port 112 is greatly reduced. In this way, an amount of energy required to evacuate water from acoustic volume 222 can also be greatly reduced over that required in conventional designs. In other words, instead of a conventional serpentine path between diaphragm 214 and audio port 110, a direct path provided in the described embodiments facilitates evacuation of water contained within acoustic volume 222 using a minimal amount of energy from, for example, a battery. It should be noted that in one embodiment, water contained within acoustic volume 222 can be expelled using a series of tones of the same or about the same frequency. In one embodiment, water can be expelled using, for example, about 10 tones of the same or about the same frequency. However, various permutations of different tones/frequencies, e.g., from going low to high, high to low, each tone at a different frequency, or multiple first tones at one frequency, multiple second tones at another frequency, etc. can be used singly or together to expel water contained within acoustic volume 222.

Figure 3:
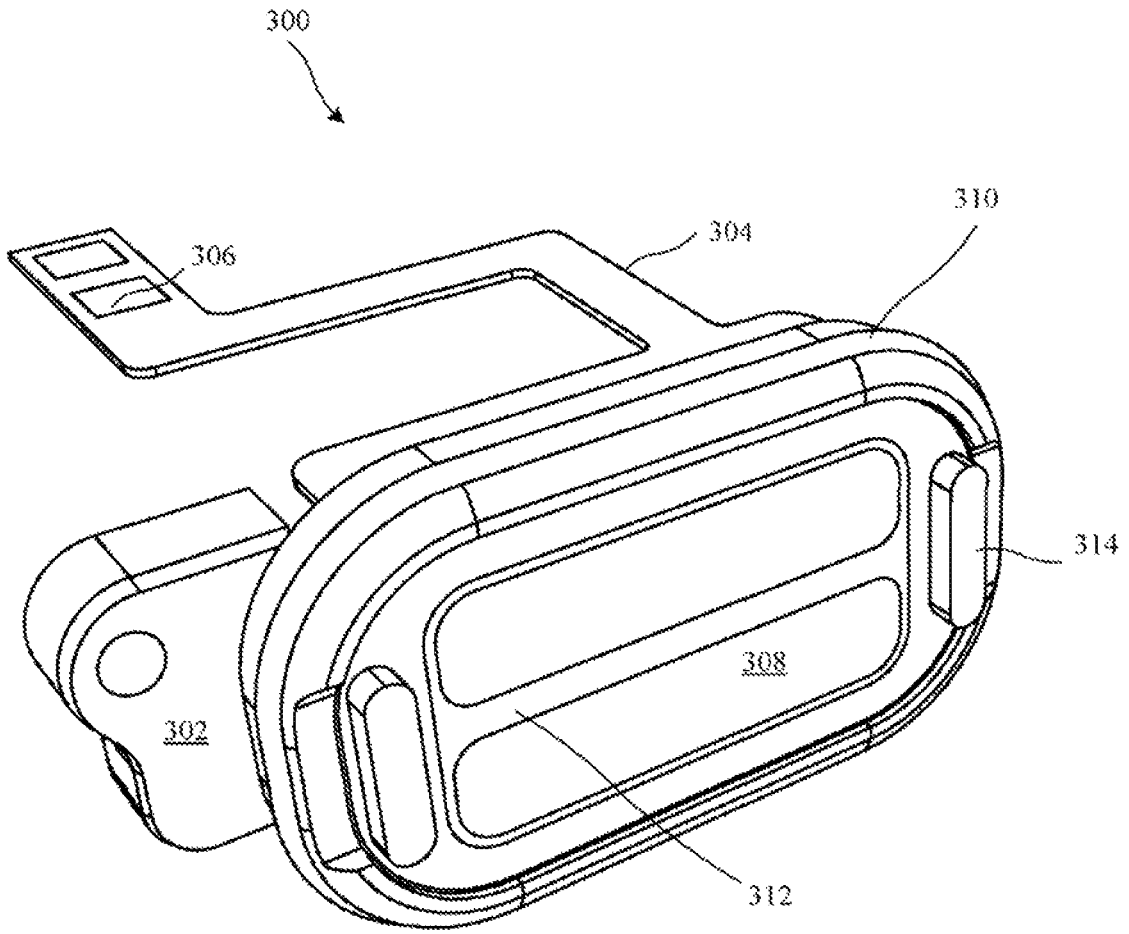
FIG. 3 shows a view of speaker assembly.

FIG. 3 shows a perspective external view of speaker assembly 300 in accordance with the described embodiments. Speaker assembly 300 can include frame 302, electrical connector 304 capable of passing an electrical signal at contacts 306 between electrical components (such as an audio processor) and speaker assembly 300. Speaker assembly 300 can also include mesh 308. Mesh 308 can provide structural support for speaker assembly 300. For example, mesh 308 can provide a force directed toward a perimeter of mesh 308 that can cause frame 302 to compress sealing element 310 against a housing (not shown) arranged to carry speaker assembly 300. In this way, a potential leak path to an interior volume defined by the housing can be blocked. Rib 312 can span mesh 308 and can also provide some structural support and can preserve a cosmetic appearance of mesh 308 by preventing wrinkling or other deformations of mesh 308. Foam 314 can be pressed against an inside surface of housing 102 providing a further seal.

Figure 4:
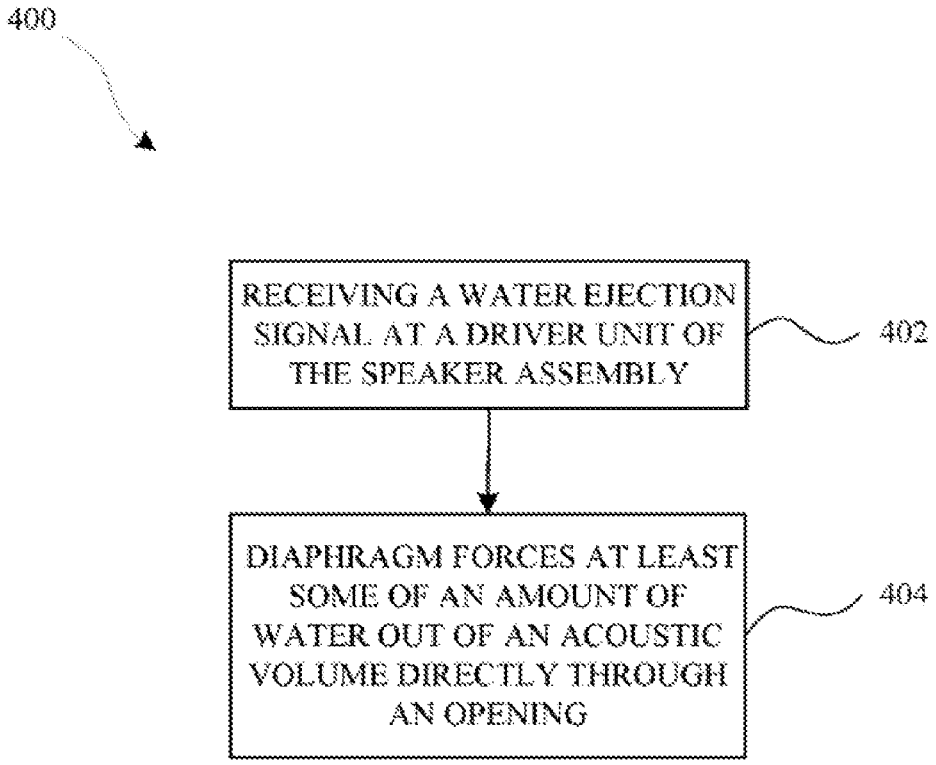
FIG. 4 shows a flow diagram representing a method for expelling water from an acoustic volume of a speaker assembly.

FIG. 4 shows a flow chart detailing process 400 for ejecting water contained within an acoustic volume of a speaker assembly in accordance with a described embodiment. Process 400 can begin at 402 by receiving a water ejection signal at a driver unit of the speaker assembly. The signal can be based upon an indication that an amount of water is entrained within an acoustic volume defined by a diaphragm mechanically coupled to the driver unit and a mesh that covers an opening in the housing. It should be noted that the diaphragm is directly aligned with the mesh and the opening is formed in such a way as to be capable of directing water from an exterior of the housing directly through the mesh and to a central portion of the diaphragm. At 404, the driver unit moves the diaphragm in a manner that forces at least some of the amount of water out of the acoustic volume directly through the opening by way of the mesh.

Figure 5:
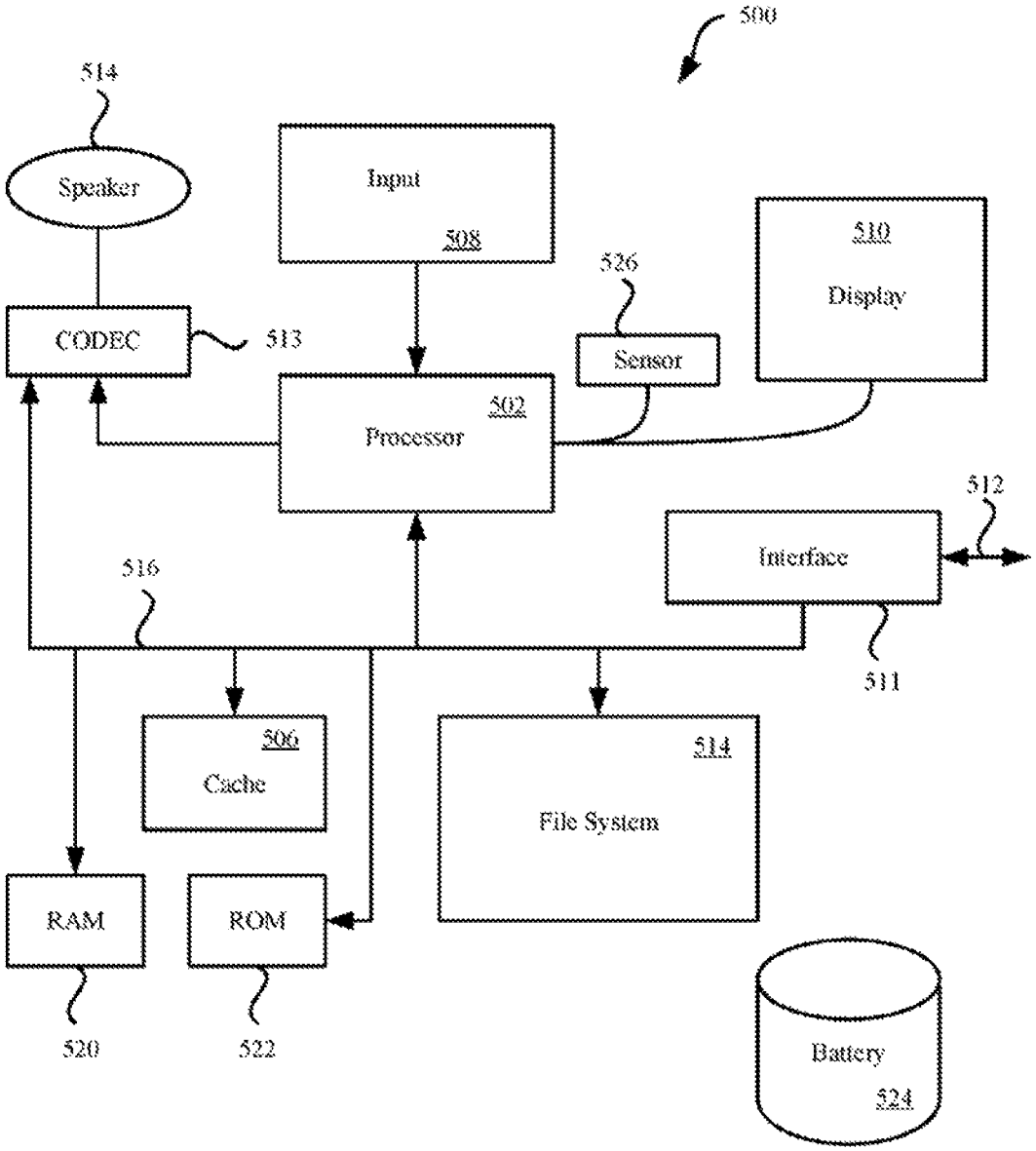
FIG. 5 shows a block diagram representing an electronic device suitable for controlling operations of internal components in accordance with the described embodiments.

FIG. 5 is a block diagram of electronic device 500 suitable for controlling operations of internal components in accordance with the described embodiments. Electronic device 500 illustrates circuitry of a representative computing device. Electronic device 500 includes a processor 502 that pertains to a microprocessor or controller for controlling the overall operation of electronic device 500. Electronic device 500 contains instruction data pertaining to manufacturing instructions in a file system 504 and a cache 506. The file system 504 is, typically, a storage disk or a plurality of disks. The file system 504 typically provides high capacity storage capability for the electronic device 500. However, since the access time to the file system 504 is relatively slow, the electronic device 500 can also include a cache 506. The cache 506 is, for example, Random-Access Memory (RAM) provided by semiconductor memory. The relative access time to the cache 506 is substantially shorter than for the file system 504. However, the cache 506 does not have the large storage capacity of the file system 504. Further, the file system 504, when active, consumes more power than does the cache 506. The power consumption is often a concern when the electronic device 500 is a portable device that is powered by a battery 524. The electronic device 500 can also include a RAM 520 and a Read-Only Memory (ROM) 522. The ROM 522 can store programs, utilities or processes to be executed in a non-volatile manner. The RAM 520 provides volatile data storage, such as for cache 506.

The electronic device 500 also includes a user input device 508 that allows a user of the electronic device 500 to interact with the electronic device 500. For example, the user input device 508 can take a variety of forms, such as a button, keypad, dial, touch screen, audio input interface, visual/image capture input interface, input in the form of sensor data, etc. Still further, the electronic device 500 includes a display 510 (screen display) that can be controlled by the processor 502 to display information to the user. A data bus 516 can facilitate data transfer between at least the file system 504, the cache 506, the processor 502, and a CODEC 513. The CODEC 513 can be used to decode and play a plurality of media items from file system 504 that can correspond to certain activities taking place during a particular manufacturing process. The processor 502, upon a certain manufacturing event occurring, supplies the media data (e.g., audio file) for the particular media item to a coder/decoder (CODEC) 513. The CODEC 513 then produces analog output signals for a speaker 514. The speaker 514 can be a speaker internal to the electronic device 500 or external to the electronic device 500. For example, headphones or earphones that connect to the electronic device 500 would be considered an external speaker.

The electronic device 500 also includes a network/bus interface 511 that couples to a data link 512. The data link 512 allows the electronic device 500 to couple to a host computer or to accessory devices. The data link 512 can be provided over a wired connection or a wireless connection. In the case of a wireless connection, the network/bus interface 511 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 526 can take the form of circuitry for detecting any number of stimuli. For example, sensor 526 can include any number of sensors for monitoring various operating conditions of electronic device 500, such as for example a Hall Effect sensor responsive to external magnetic field, a temperature sensor, an audio sensor, a light sensor such as a photometer, a depth measurement device such as a laser interferometer and so on.

A speaker assembly for an electronic device having a housing that defines an internal volume in which is carried a processor is described. The speaker assembly includes at least a frame secured to the housing by way of a sealing element, a magnetic driver coupled to the frame, the magnetic driver providing a magnetic field in response to an electrical signal from the processor, a diaphragm that is capable of moving air contained within an acoustic volume in response to the varying magnetic field, and a connecting portion that couples the acoustic membrane to the frame. The connecting portion has a folded segment having a concave shape that expands to accommodate at least some water contained within the acoustic volume. The speaker assembly also includes a mesh assembly that, in cooperation with the diaphragm, defines the acoustic volume and that includes a mesh that allows water to pass from the acoustic volume and hinders water from passing into the acoustic volume. When the electrical signal includes a water expulsion signal, the magnetic driver provides a magnetic field that causes an active portion of the diaphragm to move in a manner that expels from the housing at least some of the water contained within the acoustic volume.

An electronic device includes a housing having an opening comprising an audio port and a speaker assembly carried by the device housing. The speaker assembly includes a water ejection system having a diaphragm coupled to a magnetic driver. The speaker assembly also includes a mesh that covers the audio port where the diaphragm and the mesh together define an acoustic volume. When a water ejection signal is received at the magnetic driver, the magnetic driver causes the diaphragm to move in a manner that ejects water contained within the acoustic volume out of the acoustic volume and through the mesh.

A method performed by a speaker assembly carried by a housing of an electronic device is carried out by receiving a water ejection signal at a driver unit of the speaker assembly based upon an indication that a threshold amount of water is contained within an acoustic volume, the acoustic volume defined by a diaphragm magnetically coupled to the driver unit and a mesh that covers an opening in the housing. The diaphragm is directly aligned with the mesh and the opening is formed in such a way that water to/from an exterior of the housing is directed to follow a direct flow path that includes the mesh and a central portion of the diaphragm, and causing the central portion of the diaphragm to move in a manner the forces at least some of the amount of water out of the acoustic volume and along the direct flow path.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A wearable electronic device, comprising:

a housing, comprising:

a housing wall defining an audio port; and a speaker assembly coupled to an interior-facing surface of the housing wall to create an acoustic volume between a portion of the housing wall defining the audio port and the speaker assembly, the speaker assembly comprising:

a diaphragm configured to move air contained within the acoustic volume and that is aligned with a portion of the housing wall defining the audio port; and a mesh assembly comprising:

a mesh having a first thickness and being configured to allow water to pass out of the acoustic volume and to hinder water from passing into the acoustic volume; and a rib structure having a second thickness greater than the first thickness, the rib structure extending across a central region of the mesh assembly to oppose mechanical deformation of the mesh;

wherein the audio port comprises a first opening separated from a second opening by a portion of the housing wall and wherein the rib structure is oriented in a direction parallel to the portion of the housing wall separating the first and second openings.

2. The wearable electronic device as recited in claim 1, wherein the audio port is oriented to direct incoming water toward a central portion of the diaphragm.

3. The wearable electronic device as recited in claim 1, wherein the speaker assembly further comprises a sealing element located between the interior-facing surface of the housing wall and the speaker assembly.

4. The wearable electronic device as recited in claim 3, wherein the mesh exerts a force on the speaker assembly that, in turn, compresses the sealing element against the interior-facing surface of the housing.

5. The wearable electronic device as recited in claim 4, wherein the compressed sealing element blocks an ingress path around the speaker assembly.

6. The wearable electronic device as recited in claim 1, wherein the water expelled out of the acoustic volume follows a direct path that includes the mesh and the audio port.

7. The wearable electronic device as recited in claim 1, wherein the acoustic volume is further defined at least by the diaphragm.

8. The wearable electronic device as recited in claim 1, wherein the audio port comprises two adjacent openings defined by the housing wall.

9. A wearable electronic device, comprising:

a housing, comprising:

a housing wall defining an audio port with two adjacent openings; and a speaker assembly coupled to an interior-facing surface of the housing wall to create an acoustic volume between a portion of the housing wall defining the audio port and the speaker assembly, the speaker assembly comprising:

a diaphragm configured to move air contained within the acoustic volume and that is aligned with a portion of the housing wall defining the audio port; and a mesh assembly comprising:

a mesh having a first thickness and being configured to allow water to pass out of the acoustic volume and to hinder water from passing into the acoustic volume:

a rib structure having a second thickness greater than the first thickness, the rib structure extending across a central region of the mesh assembly to oppose mechanical deformation of the mesh; and a flex connector coupled to the speaker assembly and arranged to carry the water expulsion signal to the speaker assembly.

10. An electronic device, comprising:

a housing defining an interior volume and having a housing wall defining an audio port leading into the interior volume;

a mesh assembly covering the audio port, the mesh assembly comprising: a layer of mesh comprising a woven plastic material having pores that promote a flow of water out of the acoustic volume and hinders a flow of water into the acoustic volume, the layer of mesh extending across at least a portion of the audio port and having a first thickness, and a rib structure having a second thickness greater than the first thickness, the rib structure extending across a central region of the mesh assembly to oppose mechanical deformation of the layer of mesh; and a speaker assembly disposed within the interior volume proximate the audio port, the speaker assembly extending between opposing interior-facing surfaces of the housing wall to seal a portion of the interior volume operative as an acoustic volume between the speaker assembly and a portion of the housing wall defining the audio port, the speaker assembly comprising: a water ejection system comprising a diaphragm that is aligned with the audio port and a magnetic driver configured to generate a magnetic field that induces movement of the diaphragm to produce an audible sound by moving air contained within the acoustic volume, wherein when a water ejection signal is received at the speaker assembly, the magnetic driver causes the diaphragm to vibrate to force the water contained within the acoustic volume to follow a direct flow path through the mesh assembly and the audio port.

11. The electronic device as recited in claim 10, wherein the magnetic driver comprises an electromagnet.

12. The electronic device as recited in claim 10, wherein the audio port comprises two adjacent openings defined by the housing wall.

13. An electronic device, comprising:

a housing defining an interior volume and having a housing wall defining an audio port comprising two adjacent openings leading into the interior volume;

a mesh assembly covering the audio port, the mesh assembly comprising: a layer of mesh having a first thickness, and a rib structure having a second thickness greater than the first thickness, the rib structure extending across a central region of the mesh assembly to oppose mechanical deformation of the layer of mesh; and a speaker assembly disposed within the interior volume proximate the audio port, the speaker assembly extending between opposing interior-facing surfaces of the housing wall to seal a portion of the interior volume operative as an acoustic volume between the speaker assembly and a portion of the housing wall defining the audio port, the speaker assembly comprising: a water ejection system comprising a diaphragm that is aligned with the audio port and a magnetic driver configured to generate a magnetic field that induces movement of the diaphragm to produce an audible sound by moving air contained within the acoustic volume, wherein when a water ejection signal is received at the speaker assembly, the magnetic driver causes the diaphragm to vibrate to force the water contained within the acoustic volume to follow a direct flow path through the mesh assembly and the audio port;

wherein the structural rib is oriented substantially parallel to a portion of the housing separating the adjacent openings of the audio port.

* * * * *